US009155351B2

(12) United States Patent
Narajowski et al.

(10) Patent No.: US 9,155,351 B2
(45) Date of Patent: Oct. 13, 2015

(54) SELECTABLE BOOT ARTICULATION SYSTEM

(75) Inventors: David Narajowski, Park City, UT (US); Jacob Hall, Draper, UT (US); Brendan Perkins, Salt Lake City, UT (US); David Mellon, Park City, UT (US); Derek Gordon Gustafson, Salt Lake City, UT (US); Paul Terry, Park City, UT (US); Thomas Laakso, Park City, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 1408 days.

(21) Appl. No.: 12/263,480

(22) Filed: Nov. 2, 2008

(65) Prior Publication Data

US 2009/0113764 A1 May 7, 2009

Related U.S. Application Data

(60) Provisional application No. 60/985,654, filed on Nov. 6, 2007.

(51) Int. Cl.
*A43B 5/04* (2006.01)

(52) U.S. Cl.
CPC ..... *A43B 5/0466* (2013.01); *A43B 5/0452* (2013.01); *A43B 5/0456* (2013.01)

(58) Field of Classification Search
CPC ..... A43B 5/04; A43B 5/0452; A43B 5/0456; A43B 5/0466
USPC ..... 36/117.1, 117.2, 118.2–118.4, 36/118.7–118.9
See application file for complete search history.

(56) References Cited

U.S. PATENT DOCUMENTS

| | | | | | |
|---|---|---|---|---|---|
| 3,303,584 | A | * | 2/1967 | Werner et al. | 36/118.7 |
| 3,885,329 | A | * | 5/1975 | French | 36/118.7 |
| 4,546,558 | A | * | 10/1985 | Perini | 36/117.5 |
| 4,570,364 | A | * | 2/1986 | Walkhoff | 36/118.4 |
| 4,601,118 | A | * | 7/1986 | Zanatta | 36/118.7 |
| 4,622,765 | A | * | 11/1986 | Baratto et al. | 36/118.7 |

(Continued)

FOREIGN PATENT DOCUMENTS

| | | |
|---|---|---|
| EP | 0406212 | 1/1991 |
| EP | 0956787 | 11/1999 |

(Continued)

*Primary Examiner* — Khoa Huynh
*Assistant Examiner* — Sharon M Prange
(74) *Attorney, Agent, or Firm* — Trent Baker; Baker & Associates PLLC

(57) ABSTRACT

One embodiment of the present invention relates to a ski boot system including an upper shell, lower shell, and an articulation system. The upper and lower shell function to enable a user to move their encased foot in various dimensions/orientations corresponding to anatomical supination, pronation, dorsiflexion, and plantarflexion. The articulation system selectively affects the articulation freedom between the upper and lower shells in locked and unlocked configurations. The articulation system includes a lower shell coupler and an upper shell coupler coupled to the lower and upper shells, respectively. The locked configuration of the articulation system includes engaging the upper and lower shell couplers to restrict freedom between the upper and lower shell. The lower shell coupler is coupled within a recess in the lower shell that substantially restricts movement to a single orientation corresponding to coronal rotation.

18 Claims, 6 Drawing Sheets

(56) References Cited

U.S. PATENT DOCUMENTS

| | | | | | |
|---|---|---|---|---|---|
| 4,675,917 | A | * | 6/1987 | Valli | 2/268 |
| 4,916,835 | A | * | 4/1990 | Begey et al. | 36/118.7 |
| 5,086,573 | A | * | 2/1992 | Mabboux et al. | 36/2.6 |
| 5,363,572 | A | * | 11/1994 | Marega et al. | 36/118.7 |
| 5,401,041 | A | * | 3/1995 | Jespersen | 280/14.21 |
| 5,915,821 | A | * | 6/1999 | Okajima et al. | 36/117.1 |
| 5,927,729 | A | * | 7/1999 | Di Filippo et al. | 280/11.3 |
| 6,012,237 | A | * | 1/2000 | Okajima et al. | 36/118.2 |
| 6,076,287 | A | * | 6/2000 | Savard | 36/118.2 |
| 6,079,129 | A | * | 6/2000 | Bourdeau et al. | 36/118.2 |
| 6,101,745 | A | * | 8/2000 | Grandin et al. | 36/118.7 |
| 7,641,215 | B2 | * | 1/2010 | Ellison | 280/607 |
| 2006/0005430 | A1 | * | 1/2006 | Valat et al. | 36/117.5 |

FOREIGN PATENT DOCUMENTS

| | | |
|---|---|---|
| EP | 1010443 | 6/2000 |
| EP | 188623 | 1/2008 |
| FR | 2682571 | 4/1993 |

* cited by examiner

SELECTABLE BOOT ARTICULATION SYSTEM

RELATED APPLICATIONS

This application claims priority to U.S. provisional application Ser. No. 60/985,654 filed Nov. 6, 2007, the contents of which are incorporated by reference.

FIELD OF THE INVENTION

The invention generally relates to a selectable boot articulation system. In particular, the invention relates to a system for selectable articulation configurations between components of a boot.

BACKGROUND OF THE INVENTION

A boot is a type of footwear that encases both the foot and a portion of the lower leg of a user. Boots are generally manufactured for a particular purpose or activity and therefore are designed to include characteristics consistent with the intended purpose. For example, a hiking boot is designed to support the ankle of a user while minimizing the overall weight. Likewise, a ski boot is designed to maximize a user's performance at a particular skiing activity.

Boots generally include a shell, a compression system, and a sole. The shell and compression system operate to encase and support the foot and lower leg of a user. Various well-known shell and compression systems are utilized to allow users to insert and remove their feet in an open boot configuration and compress the shell around the foot in a closed boot configuration. The sole of a boot is disposed on the bottom surface of the shell. The sole is generally composed of a rubber or plastic material. The sole may consist of a single piece or multiple blocks. The stiffness and/or weight characteristics of the sole have an effect on the overall performance of the boot.

Existing boot systems often include some form of articulation system coupling portions of the shell together to allow for selectable articulation to facilitate sufficient walking/skinning performance in addition to optimal skiing performance. These articulation systems are generally switchable between a locked configuration and an unlocked configuration. The locked configuration corresponds to supporting the shell components to facilitate optimal skiing characteristics. The unlocked configuration corresponds to enabling desired movement between the shell components to facilitate optimal walking and/or skinning. Unfortunately, these existing articulation systems often fail to properly provide support in the locked configuration and often cause undesirable vibrations due to the dimensional freedom necessary to provide the unlocked configuration.

Therefore, there is a need in the industry for a boot articulation system that provides desired support characteristics in the locked configuration and provides the necessary articulation in the unlocked configuration.

SUMMARY OF THE INVENTION

The present invention relates to boot articulation systems that selectively affect the articulation freedom of user's foot within a boot. One embodiment of the present invention relates to a ski boot system including an upper shell, lower shell, and an articulation system. The upper shell is encapsulated around a portion of the user's lower leg, and the lower shell is encapsulated around a user's foot. The upper and lower shells function to enable a user to move their encased foot in various dimensions/orientations corresponding to anatomical supination, pronation, dorsiflexion, and plantarflexion. The articulation system selectively affects the articulation freedom between the upper and lower shells in locked and unlocked configurations. The locked configuration of the articulation system corresponds to restricting a plurality of dimensional articulation freedom between the upper and lower shell. The articulation system includes a lower shell coupler and an upper shell coupler coupled to the lower and upper shells, respectively. The lower shell coupler may extend internally within the upper shell. The locked configuration of the articulation system includes engaging the upper and lower shell couplers to restrict freedom between the upper and lower shell. The lower shell coupler is coupled within a recess in the lower shell that substantially restricts movement to a single orientation corresponding to coronal rotation. Coronal rotation between the lower shell coupler and the lower shell corresponds to anatomical supination and pronation with respect to the manner in which a corresponding user's foot is oriented in the lower shell. The coupling between the lower shell coupler and the lower shell may enable more than one degree and less than five degrees of coronal rotational freedom in both the locked and unlocked configurations of the articulation system. Alternative embodiments may include incorporating a similar coupling between the upper shell and upper shell coupler that substantially restricts movement to coronal rotation. The upper shell coupler coupling to the upper shell may be used in conjunction with a lower shell coupler coupling or in the alternative. The articulation system may also include a switching mechanism that selectively switches between the locked and unlocked configuration.

Embodiments of the present invention represent a significant advance in the field of ski boot articulation systems. Conventional articulation systems utilize an intentional loose rigid coupling between the lower shell coupler and the lower shell to allow the necessary articulation freedom between the lower and upper shell. However, the loose coupling allows a plurality of undesirable movement orientations/dimensions between the lower shell and lower shell coupler. Therefore, in both a locked and unlocked configuration, the upper and lower shells are able to articulate in plurality of orientations due to the loose coupling between the lower shell coupler and the lower shell. Undesirable vibrations occur as a result of the plurality of movement orientations between the upper and lower shell in a locked configuration. Conventional articulation systems thereby fail to properly restrict movement between the lower shell coupler and the lower shell to a single orientation and rather allow a plurality of movements orientations commonly referred to as slop. Embodiments of the present invention substantially restrict movement between the lower shell coupler and the lower shell to a single orientation, thereby eliminating undesirable movements and/or vibrations between the upper and lower shell in the locked configuration of the articulation system.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. The Figures presented in conjunction with this description are views of only particular-rather than complete-portions of the systems and methods of making and using the system according to the invention. In the Figures, the physical dimensions may be exaggerated for clarity.

DETAILED DESCRIPTION OF THE INVENTION

Figure 1:
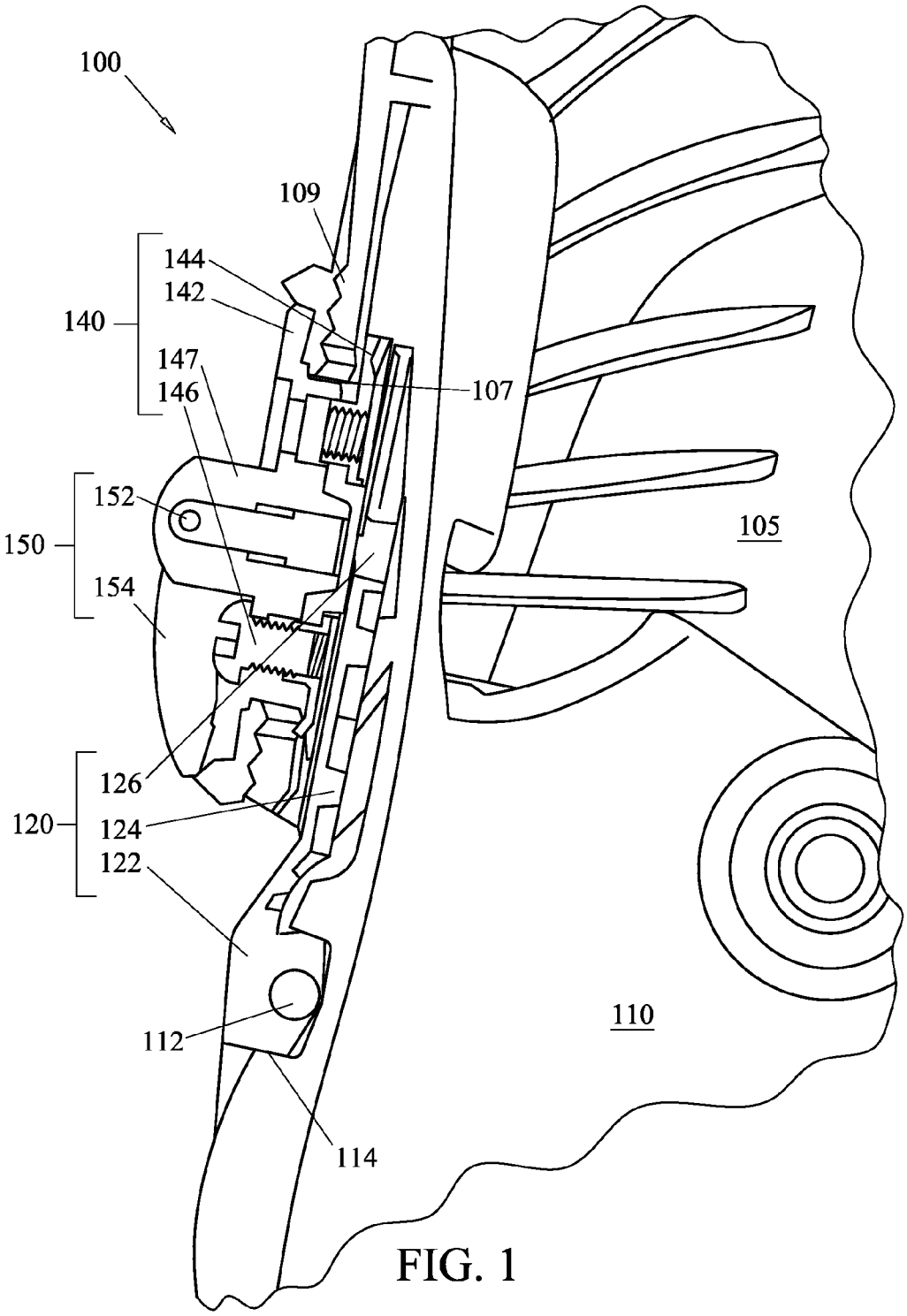
FIG. 1 illustrates a sagittal cross-sectional view of an articulation system on a boot system in accordance with one embodiment of the present invention.

The present invention relates to boot articulation systems that selectively affect the articulation freedom of user's foot within a boot. One embodiment of the present invention relates to a ski boot system including an upper shell, lower shell, and an articulation system. The upper shell is encapsulated around a portion of the user's lower leg, and the lower shell is encapsulated around a user's foot. The upper and lower shells function to enable a user to move their encased foot in various dimensions/orientations corresponding to anatomical supination, pronation, dorsiflexion, and plantarflexion. The articulation system selectively affects the articulation freedom between the upper and lower shells in locked and unlocked configurations. The locked configuration of the articulation system corresponds to restricting a plurality of dimensional articulation freedom between the upper and lower shell. The articulation system includes a lower shell coupler and an upper shell coupler coupled to the lower and upper shells, respectively. The lower shell coupler may extend internally within the upper shell. The locked configuration of the articulation system includes engaging the upper and lower shell couplers to restrict freedom between the upper and lower shell. The lower shell coupler is coupled within a recess in the lower shell that substantially restricts movement to a single orientation corresponding to coronal rotation. Coronal rotation between the lower shell coupler and the lower shell corresponds to anatomical supination and pronation with respect to the manner in which a corresponding user's foot is oriented in the lower shell. The coupling between the lower shell coupler and the lower shell may enable more than one degree and less than five degrees of coronal rotational freedom in both the locked and unlocked configurations of the articulation system. Alternative embodiments may include incorporating a similar coupling between the upper shell and upper shell coupler that substantially restricts movement to coronal rotation. The upper shell coupler coupling to the upper shell may be used in conjunction with a lower shell coupler coupling or in the alternative. The articulation system may also include a switching mechanism that selectively switches between the locked and unlocked configuration. Also while embodiments of the present invention are directed at selectable boot articulation systems, it will be appreciated that teachings of the present invention are applicable to other areas.

The following terms are defined as follows:

Ski—Any type of skiing apparatus that allows a user to translate on a snow surface, including but not limited to cross country skis, alpine skis, powder skis, telemark skis, downhill skis, snowboards, splitboards, skiboards, etc.

Ski Boot—A boot used for translating on a snow surface including but not limited to snow sport boots for any type of skiing, snowboarding, etc.

Sagittal plane—An anatomical plane oriented vertically so as to bisect the left and right portions of the body. The sagittal plane is used herein for orientation purposes with respect to a boot as it is related to a human foot and lower leg. A boot which is placed on a human foot is effectively oriented sagittally (parallel to the sagittal plane) in a profile perspective. Therefore, the bottom of the boot is sagittally below the top of the boot. The term "sagittally" may also refer to a position within the sagittal plane such as an elevation.

Transverse plane—An anatomical plane oriented horizontally so as to bisect the top and bottom portions of the body. The transverse plane is used herein for orientation purposes with respect to a boot as it is related to a human foot and lower leg. A boot which is placed on a human foot is oriented orthogonally to the transverse plane. Therefore, a transversely oriented member on the boot would extended horizontally or between the sides of the boot. For example, the bottom surface of the boot may three dimensionally extend transversely.

Coronal plane—An anatomical plane oriented vertically so as to bisect the front and rear portions of the body. The coronal plane is used herein for orientation purposes with respect to a boot as it is related to a human foot and lower leg. Therefore, the coronal plane vertically bisects a boot between the toe and the heel. The anatomical movements of supination and pronation are effectively coronal rotations of the foot about the ankle. Likewise, corresponding movements of boot components such as shell portions may also be described in terms of movements corresponding to how a user's foot would move.

Supination and Prontation—Coronal movements of the foot about the ankle.

Dorsiflexion and Plantarflexion—Sagittal movements of the foot about the ankle.

Embodiments of the present invention relate to snow sport boot systems incorporating an articulation system that affect the freedom of movement of a user's foot within the boot system. The articulation system generally includes a locked configuration and an unlocked configuration which correspond to skiing and walking configurations respectively. The locked configuration generally restricts movement and supports the user's foot and lower leg for optimal ski performance characteristics. Likewise, the unlocked configuration allows movement of the user's foot and lower leg for optimal walking and/or skinning performance and efficiency characteristics. The discussion below relates to a single operational embodiment of a boot system and articulation system. This single embodiment is described and illustrated in detail to provide one example of a system that effectively restricts movement without introducing undesired movement orientations. It will be appreciated that numerous other embodiments have been contemplated and that nothing herein should be interpreted to limit the claims to the single embodiment discussed below.

Reference is initially made to FIG. 1, which illustrates a sagittal cross-sectional view of an articulation system on a boot system, designated generally at 100. The illustrated view is located at the rear/heel region of the boot at the intersection between the lower and upper shell. The boot system 100 includes a lower shell 110, an upper shell 105, and an articulation system. The articulation system includes a lower shell coupler 120, an upper shell coupler 140, and a switching mechanism 150. The lower shell coupler 120 and upper shell coupler 140 are coupler to the lower and upper shell 110, 105 respectively.

The lower shell coupler 120 includes an elongated upper member 124 that extends within a portion of the upper shell 105. The lower shell coupler 120 also includes a curved lower member 122 coupled within a recess 114 of the lower shell. The coupling between the curved lower member 122 within the recess 114 includes extending a transverse pin 112 through both the curved member 122 and the recess 114. The coupling substantially restricts movement between the lower shell coupler 120 and the lower shell 110 to a single orientation corresponding to coronal rotation, supination, and pronation. The coupling between the lower shell coupler 120 and the lower shell 110 will be further described and illustrated in more detail below. The lower shell coupler 120 also includes a switching recess 126 disposed on the elongated upper member 124. The switching recess 126 is utilized to provide a selective coupling between the upper and lower shell couplers 120, 140 via the selective engagement of the switching mechanism 150 for purposes of engaging the locked configuration of the articulation system.

The upper shell coupler 140 includes an external plate member 142 and an internal plate member 144 sandwich coupled to the upper shell 105 via a plurality of couplers 146. The external plate member 142 is disposed on an external region of the upper shell 105 and the internal plate member 144 is aligned therewith and disposed on an internal region of the upper shell 105. The external plate member 142 and internal plate member 144 are coupled to one another through a channel in the upper shell 107. The upper shell 105 includes a ribbed region 109 across which the external plate member 142 is disposed. The ribbed region 109 prevents translational movement of the external plate member 142 with respect to the upper shell 105. The plurality of couplers 146 extend through the external plate member 142, upper shell 105, and the internal plate member 144 thereby creating the sandwich coupling between the upper shell coupler 140 and the upper shell 140. The plurality of couplers 146 may be any elongated couplers including but not limited to screws, pins, bolts, etc. The internal plate member 144 may include threaded recesses through which the plurality of couplers 146 extend. The coupling between the upper shell coupler 140 and the upper shell 105 will be further described and illustrated in more detail below. The upper shell coupler 140 further includes a housing 147 that provides a region within which the switching mechanism 150 may selectively couple the upper and lower shell couplers 140, 120 to engage the locked configuration.

The switching mechanism 150 includes a toggle switch 154 and a pin 152 disposed within the housing 147 of the upper shell coupler 140. It will be appreciated that various switching mechanisms and operative switch positions may be utilized in accordance with embodiments of the present invention. The toggle switch 154 is a two-position 180 degree switch operatively coupled to the pin 152 such that a first position corresponds to the pin 152 being retracted and a second position corresponds to the pin 152 being extended. The pin 152 is illustrated in a retracted position that includes substantial containment within the housing 147. The extended position of the pin 152 corresponds to the pin 152 extending through the switching recess 126 of the lower shell coupler 120. The extended position of the pin 152 effectively rigidly couples the lower shell coupler 120 and the upper shell coupler 140 which thereby impedes sagittal and torsional translation between the upper and lower shell 105, 110 corresponding to the locked configuration. However, the coupling between the upper and lower shell couplers 140, 120 does not restrict all movement between the upper and lower shell 105, 110. The coupling between the lower shell coupler 120 and the lower shell 110 allows a restricted movement in the coronal rotation orientation. Therefore, even if the upper and lower shell couplers 140, 120 are intercoupled, the upper shell 105 will be able to articulate in a coronal rotation orientation as defined by the coupling between the curved lower member 122 and the recess 114.

Figure 2A:
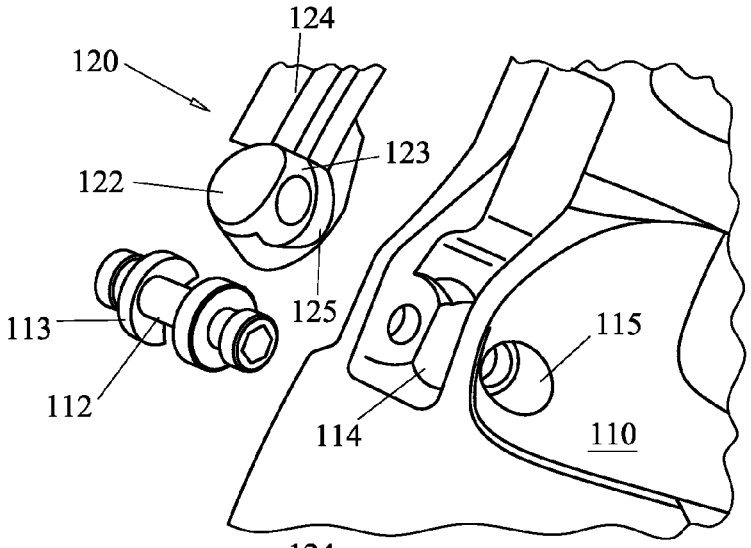
FIGS. 2A-2C illustrate detailed rear exploded perspective views of the lower shell coupler and lower shell in accordance with the embodiment illustrated in FIG. 1.
Figure 2B:
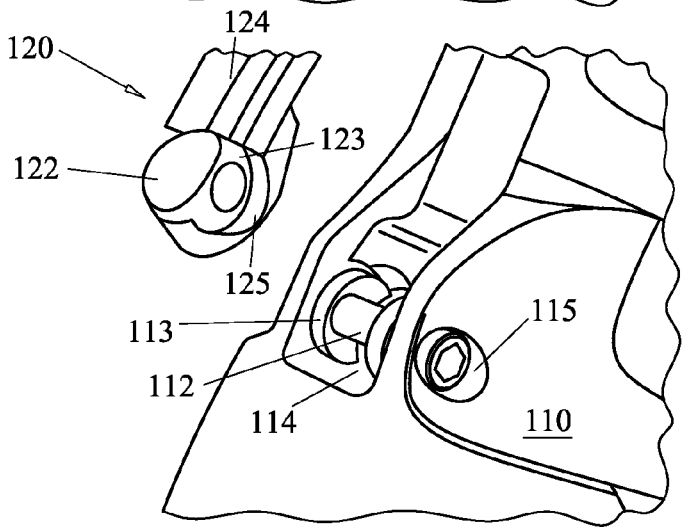
Figure 2C:
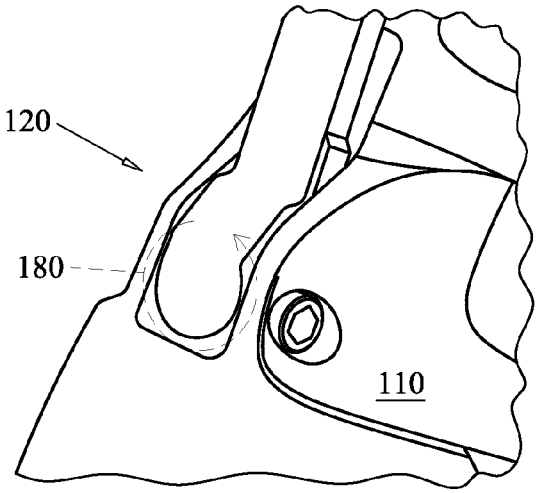

Reference is next made to FIGS. 2A-2C, which illustrate detailed rear exploded perspective views of the lower shell coupler 120 and lower shell 110. As described above, the curved lower member 122 is positioned within the recess 114 of the lower shell 110 to restrict movement to a single dimensional orientation. The curved lower member 122 includes two oppositely oriented convexly curved surfaces 123 (only one of which is visible) and two hooded regions 125 (only one of which is visible). The curved surfaces 123 are curved in a coronal rotational orientation consistent with the arrow 180 illustrated in FIG. 2C. The curved surfaces 123 are also geometrically shaped to restrict the degree of rotation within particular parameters. The hooded regions 125 correspond with the curved surfaces 125 to restrict movement. For example, the hooded regions 125 restrict the lower coupler 120 from rotating transversely within the recess 114 corresponding to a torsional type rotation. Likewise, the lower shell 110 includes a transverse pin 112, two pin recesses 115, and two spacers 113. The transverse pin 112 may extend through the two pin recesses 115, the spacers 113, the lower shell coupler 120, and the lower shell 110 as illustrated to effectively maintain a movable coupling between the lower shell coupler 120 and the lower shell 110. The spacers 113 are disposed within the recess 114 of the lower shell 110 and on opposite sides of the lower curved member 122. The spacers 113 each include a concave curved surface facing inward corresponding to the curved surfaces 123 of the lower shell coupler 120. The spacers 113 and curved lower member 122 are shaped to tightly fit within the recess 114 as illustrated in FIG. 2C. The illustrated coupling scheme between the lower shell coupler 120 and the lower shell 110 substantially restricts movement freedom between the lower shell coupler 120 and the lower shell 110 to coronal rotation (represented by arrow 180) corresponding to anatomical supination and pronation. It will be appreciated that a similar coupling that restricts movement to coronal rotation may be implemented between the upper shell coupler 140 and the upper shell 105 in accordance with alternative embodiments of the present invention.

Figures 3A, 3B, 3C:
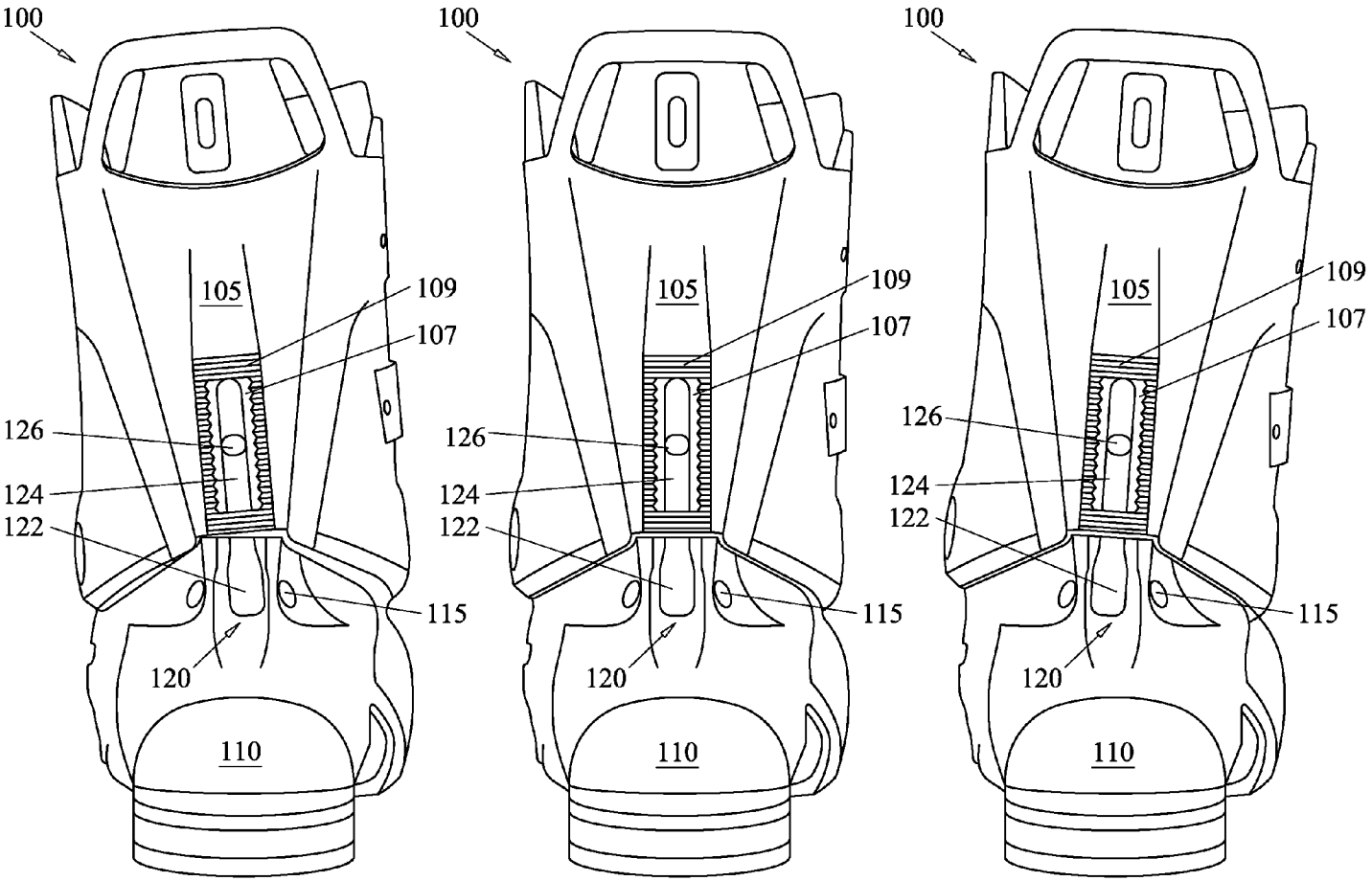
FIGS. 3A-3C illustrate rear coronal rotational views of the lower shell coupler, lower shell, and upper shell in accordance with the embodiment illustrated in FIG. 1.

Reference is next made to FIGS. 3A-3C, which illustrate rear coronal rotational views of the lower shell coupler 120, lower shell 110, and upper shell 105. For explanatory purposes, the upper shell coupler 140 has been removed from the illustrated boot systems 100. As discussed above, the coupling scheme between the lower shell coupler 120 and the lower shell 110 allow for coronal rotation between the lower shell coupler 120 and the lower shell 110. In addition, the elongated upper member 124 of the lower shell coupler 120 may be disposed within the channel 107 of the upper shell 105 thereby aligning the upper shell 105 with the elongated upper member 124 of the lower shell coupler 120. The elongated upper member 124 of the lower shell coupler 120 is further contained within the channel 107 of the upper shell 105 by the positioning of the upper shell coupler 140 (not shown) over the channel. The upper shell 105 is free to articulate or rotate to either side corresponding to supination and pronation of the user's foot. FIG. 3A illustrates the upper shell 105 coronally rotating to the left with respect to the lower shell 110 in accordance with a pronation movement. FIG. 3B illustrates a neutral positioning of the upper shell 105 with respect to the lower shell 110. FIG. 3C illustrates the upper shell 105 coronally rotating to the right with respect to the lower shell 110 in accordance with a supination movement. The coupling of the upper shell coupler 140 (not shown) to the lower shell coupler 120 does not substantially affect the ability of the upper shell 105 to coronally rotate in the manner illustrated. Therefore, the upper shell 105 is able to coronally rotate in both the locked and unlocked configurations of the articulation system.

Figure 4A:
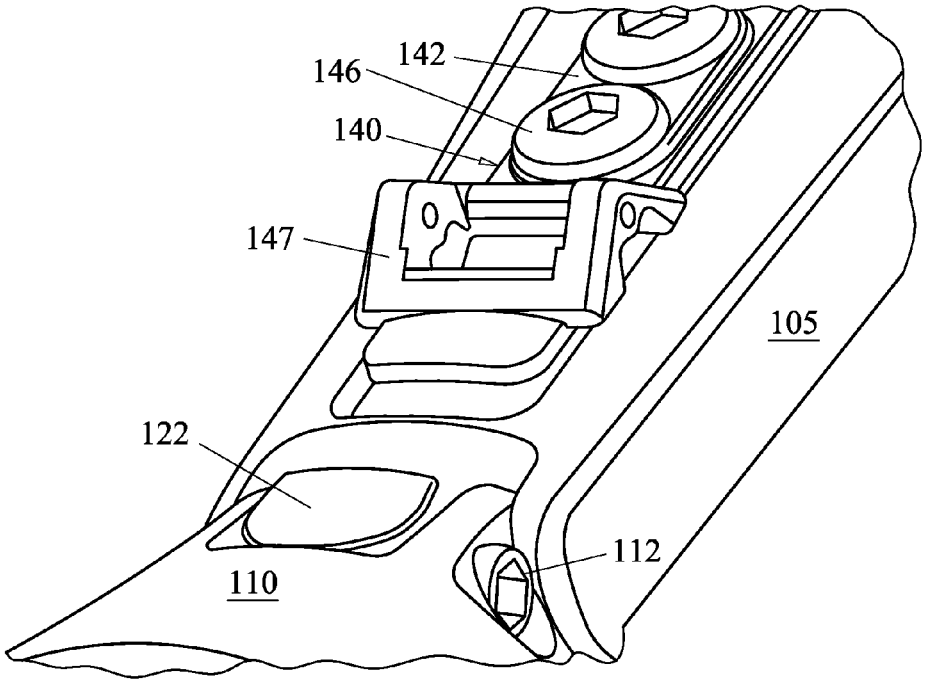
FIG. 4A illustrates a perspective view of the upper shell, lower shell, upper shell coupler, and lower shell coupler in accordance with the embodiment illustrated in FIG. 1.
Figure 4B:
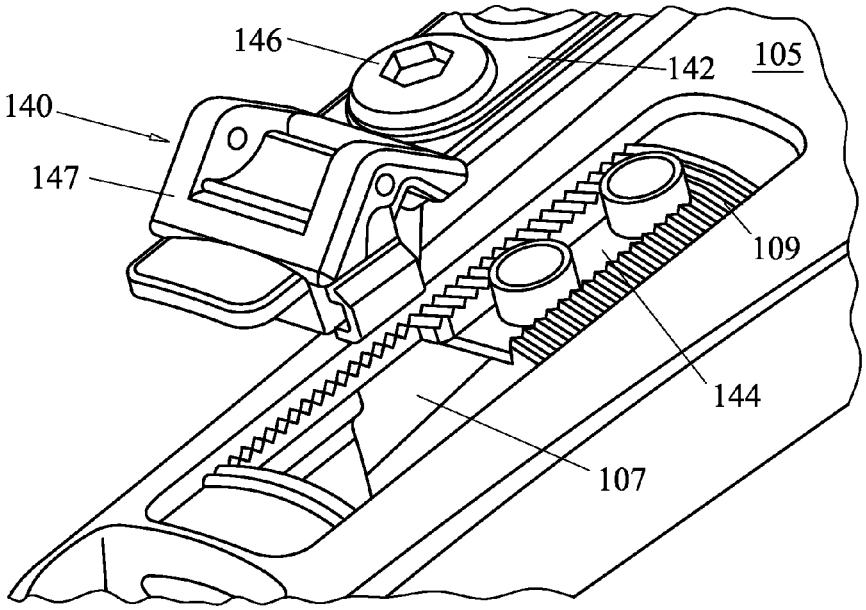
FIG. 4B illustrates an exploded perspective view of the upper shell, upper shell coupler, and lean adjustment system in accordance with the embodiment illustrated in FIG. 1.

Reference is next made to FIGS. 4A-4B, which illustrate perspective views of the upper shell 105 and upper shell coupler 140. The upper shell coupler 140 is sandwich coupled to the upper shell 105 through the channel 107. FIG. 4A specifically illustrates how the upper shell coupler 140 and upper shell 105 may sagittally rotate or lean with respect to the lower shell 110 and lower shell coupler 120. FIG. 4B specifically illustrates the coupling scheme between the upper shell coupler 140 and the upper shell 105 including the sandwich coupling between the external plate member 142 and internal plate member 144 across the ribbed region 109 and within the channel 107 of the upper shell 105. The plurality of couplers 146 extend through the external plate member 142, upper shell 105, and the internal plate member 144. The internally oriented surface of the external plate member 142 may include a corresponding ribbed region (not visible) that interfaces with the ribbed region 109 of the upper shell 105 to prevent translation and allow adjustment. The housing 147 provides the structure for the switching mechanism 150 (not shown) that switches between the locked and unlocked configurations.

Figure 5A:
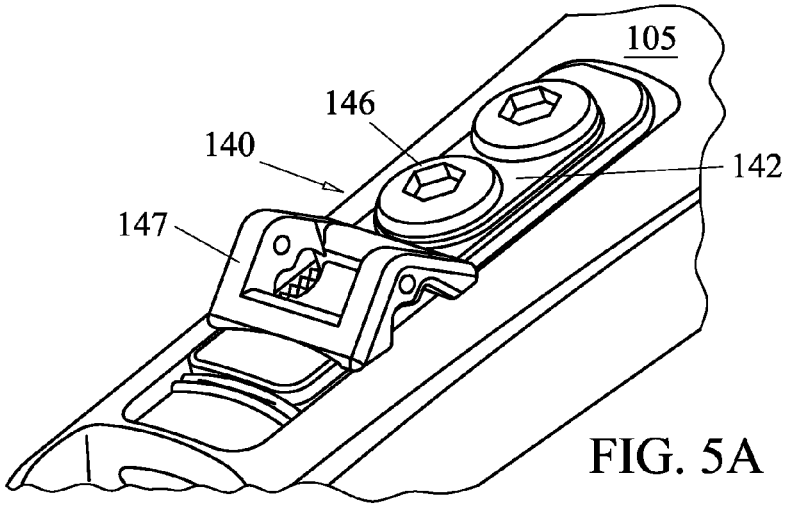
FIGS. 5A-5C illustrate rear perspective views of the upper shell and upper shell coupler in various lean adjustment positions in accordance with the embodiment illustrated in FIG. 1.
Figure 5B:
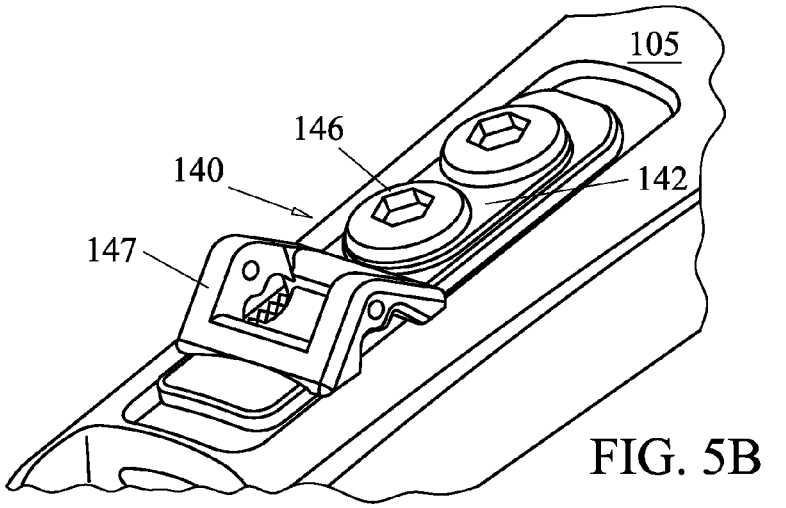
Figure 5C:
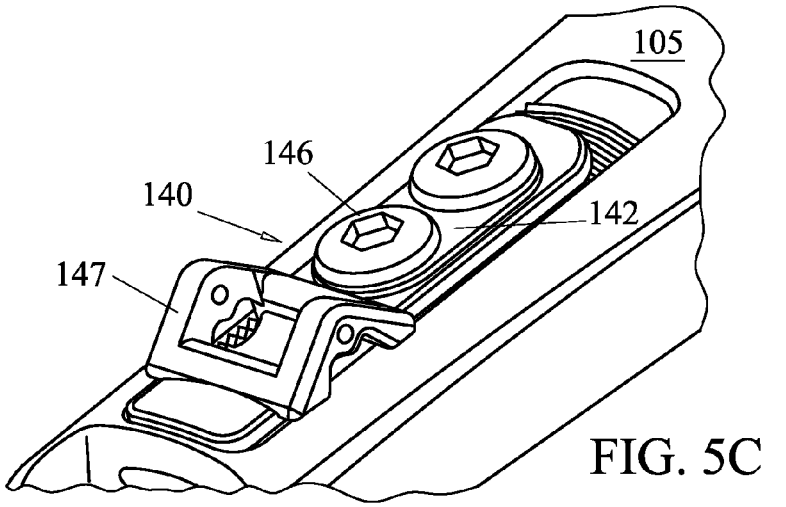

Reference is next made to FIGS. 5A-5C, which illustrate rear perspective views of the upper shell 105 and upper shell coupler 140 in various adjusted coupling positions corresponding to a lean adjustment between the upper shell 105 and the lower shell 110 (not shown). The upper shell coupler 140 may be coupled at various translational positions on the upper shell 105 to adjust the sagittal position at which the upper shell 105 couples to the lower shell 110 in the locked configuration. Since the locked configuration corresponds to engaging the upper and lower shell couplers 140, 120, a translation of the upper shell coupler 140 with respect to the upper shell 105 will affect the sagittal position at which the locked configuration restricts movement between the upper shell 105 and lower shell 110. This sagittal rotational positioning is commonly referred to as the lean because it corresponds to the dorsiflexion and plantarflexion articulation of the user's foot with respect to their lower leg. In operation, the plurality of couplers 146 may be loosened to enable the upper shell coupler 140 to translate within channel and adjust the lean angle. The plurality of couplers must be retightened to prevent inadvertent slippage after the lean angle adjustment is made. The ribbed region 109 of the upper shell 105 may geometrically engage with a corresponding ribbed surface on the internally oriented surface of the external plate member 142 so as to prevent movement when the plurality of couplers 146 are tightened, thereby engaging the sandwich coupling.

Figure 6A:
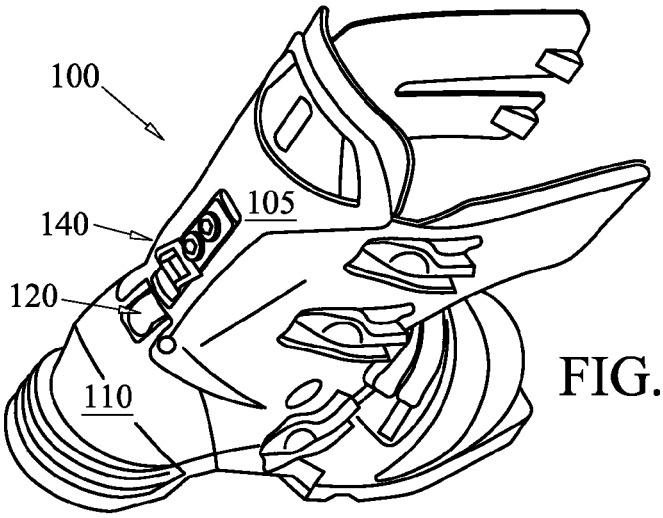
FIGS. 6A-6C illustrate perspective views of the boot system in various lean adjustment positions in accordance with the embodiment illustrated in FIG. 1.
Figure 6B:
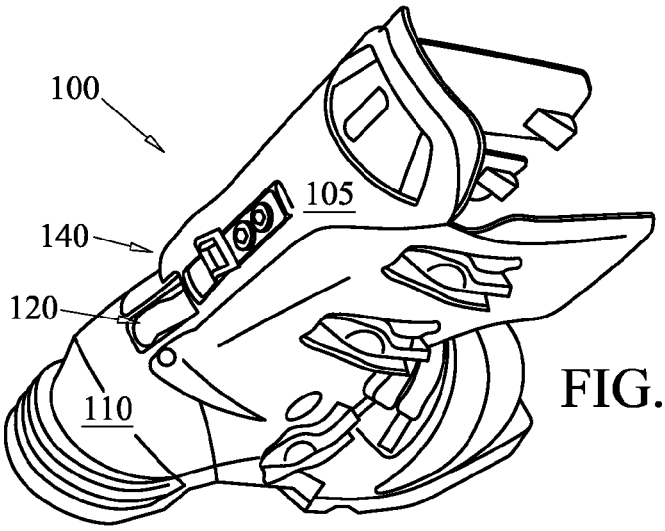
Figure 6C:
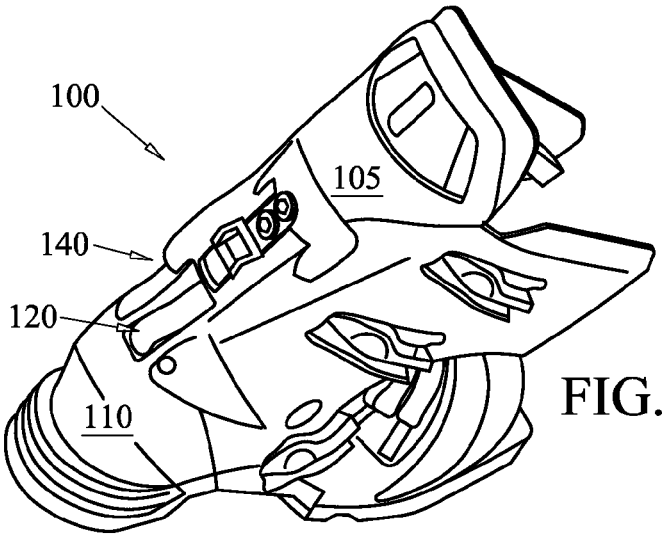

Reference is next made to FIGS. 6A-6C, which illustrate perspective views of the boot system in various lean adjustment positions in the locked configuration, designated generally at 100. As described above, the coupling between the upper shell coupler 140 and the upper shell 105 may be translationally adjusted to affect the lean angle (sagittal rotation) between the upper and lower shell 105, 110 in the locked configuration of the articulation system. FIG. 6A illustrates the upper shell 105 sagittally rotating backward with respect to the lower shell 110 corresponding to plantarflexion of a user's foot. FIG. 6B illustrates the upper shell 105 sagittally rotating forward with respect to the lower shell 110 corresponding to dorsiflexion of a user's foot.

One non-illustrated alternative embodiment incorporates telescoping linkages rather than the type of upper and lower couplers 140, 120 illustrated in the embodiment described above. The telescoping linkages may similarly be moveably coupled to the upper and lower shell 105, 110 in a manner that restricts movement to coronal rotation between the upper and lower shell 105, 110. An alternative boot system incorporating the telescoping linkages may also be switched between a similar locked/unlocked configuration to selectively enable sagittal rotation between the upper and lower shells 105, 110. Likewise, the coupling between the telescoping linkage and the upper and lower shells 105, 110 may be adjusted to select various default forward lean and coronal canting configurations.

Various other embodiments have been contemplated including combinations in whole or in part of the embodiments described above.

What is claimed is:

1. A ski boot system comprising:

an upper shell configured to encase a portion of a user's lower leg;

a lower shell configured to encase a user's foot, wherein the lower shell is moveably coupled with the upper shell;

an articulation system coupled to the upper and lower shell including a locked configuration and an unlocked configuration, wherein the locked configuration restricts movement between the upper and lower shell in a plurality of orientations, and wherein the unlocked configuration enables articulation freedom between the upper and lower shell in a plurality of orientations corresponding to anatomical supination, pronation, dorsiflexion, and plantarflexion between the upper and lower shell, and wherein the articulation system is configured to enable a selective engagement of the locked configuration and the unlocked configuration directly by hand;

wherein the articulation system includes an upper shell coupler and a lower shell coupler coupled to the upper and lower shell respectively, and wherein the locked configuration corresponds to an engagement between the upper shell coupler and the lower shell coupler, and wherein the unlocked configuration corresponds to a disengagement between the upper shell coupler and the lower shell coupler, and wherein the lower shell coupler is coupled within a recess of the lower shell so as to substantially restrict freedom between the lower shell coupler and the lower shell to coronal rotation corresponding to anatomical supination and pronation; and wherein the coupling between the lower shell coupler and the lower shell includes extending a transverse pin through the recess and the lower shell coupler, wherein the recess includes two spacers disposed on the transverse pin and on opposite transverse sides of the lower shell coupler, and wherein the two spacers include opposite concave curvatures oriented toward the lower shell coupler, and wherein the lower shell coupler includes corresponding outward oriented convex curvatures.

2. The ski boot system of claim 1, wherein the recess of the lower shell is a three dimensional recess including a coronally oriented curvature corresponding to a supination and pronation movement between the lower shell coupler and the lower shell.

3. The ski boot system of claim 1, wherein the curvatures on the first spacer, second spacer, and lower shell coupler enable the lower shell coupler to coronally rotate about the transverse pin in a manner corresponding to supination and pronation.

4. The ski boot system of claim 3, wherein the curvatures of the lower shell coupler are shaped to restrict the coronal rotation of the lower shell coupler to within five degrees in both coronal rotation directions corresponding to supination and pronation.

5. The ski boot system of claim 3, wherein the lower shell coupler includes a hooded region adjacent to the convex curvatures that restricts torsional movement between the lower shell coupler and the lower shell.

6. The ski boot system of claim 3, wherein a shape of the lower shell coupler and the recess restrict movement between the lower shell coupler and the lower shell in all orientations other than coronal rotation corresponding to anatomical supination and pronation.

7. The ski boot system of claim 3, wherein a shape of the lower shell coupler and the recess restrict torsional rotational movement between the lower shell coupler and the lower shell.

8. The ski boot system of claim 1, wherein the articulation system includes a selectable locking mechanism configured to selectably engage and release the coupling between the lower shell coupler and the upper shell coupler corresponding to the locked configuration and the unlocked configuration respectively.

9. The ski boot system of claim 8, wherein the selectable locking mechanism includes a retractable pin coupled to the upper shell coupler and configured to selectably extend through a recess in the lower shell coupler.

10. The ski boot system of claim 9, wherein the retractable pin is moveably coupled with a toggle switch such that a first position of the toggle switch corresponds to the pin being extended through the recess in the lower shell coupler and a second position of the toggle switch corresponds to the pin being retracted from the recess in the lower shell coupler.

11. The ski boot system of claim 1, wherein the upper shell coupler includes a lean adjustment system configured to adjust a position at which the upper shell coupler engages with the lower shell coupler for the locked configuration, wherein the position corresponds to a forward or rearward lean angle in the locked configuration.

12. The ski boot system of claim 11, wherein the lean adjustment system further includes a translationally adjustable sandwich coupling between the upper shell coupler and the upper shell.

13. The ski boot system of claim 11, wherein the lean adjustment system enables an adjustment range between ten degrees of forward lean and ten degrees of rearward lean between the upper and lower shell in the locked configuration.

14. The ski boot system of claim 1, wherein the lower shell coupler is disposed in part internally within the upper shell.

15. The ski boot system of claim 1, wherein the upper shell coupler is externally disposed on the upper shell.

16. The ski boot system of claim 1, wherein the locked and unlocked configurations enable more than one degree and less than five degrees of coronal rotational freedom between the upper and lower shell corresponding to supination and pronation.

17. A ski boot system comprising:

an upper shell configured to encase a portion of a user's lower leg;

a lower shell configured to encase a user's foot, wherein the lower shell is moveably coupled with the upper shell;

an articulation system coupled to the upper and lower shell including a locked configuration and an unlocked configuration, wherein the locked configuration restricts movement between the upper and lower shell in a plurality of orientations, and wherein the unlocked configuration enables articulation freedom between the upper and lower shell in at least two orientations corresponding to anatomical supination, pronation, dorsiflexion, and plantarflexion between the upper and lower shell, and wherein the articulation system is configured to enable a selective engagement of the locked configuration and the unlocked configuration directly by hand;

wherein the articulation system includes an upper shell coupler and a lower shell coupler coupled to the upper and lower shell respectively, and wherein the locked configuration corresponds to an engagement between the upper shell coupler and the lower shell coupler, and wherein the unlocked configuration corresponds to a disengagement between the upper shell coupler and the lower shell coupler, and wherein the lower shell coupler is coupled within a recess of the lower shell to restrict freedom between the lower shell coupler and the lower shell to orientations corresponding to anatomical supination and pronation, and wherein the recess of the lower shell is a three dimensional recess including a coronally oriented curvature; and wherein the articulation system includes a selectable locking mechanism configured to selectably engage and release the coupling between the lower shell coupler and the upper shell coupler corresponding to the locked configuration and the unlocked configuration respectively, and wherein the selectable locking mechanism includes a retractable pin configured to selectably extend substantially orthogonal to the lower shell through a recess in the lower shell coupler, and wherein the retractable pin is moveable with a toggle switch such that a first position of the toggle switch corresponds to the pin being extended through the recess in the lower shell coupler and a second position of the toggle switch corresponds to the pin being retracted from the recess in the lower shell coupler.

18. A ski boot system comprising:

an upper shell configured to encase a portion of a user's lower leg;

a lower shell configured to encase a user's foot, wherein the lower shell is moveably coupled with the upper shell;

an articulation system coupled to the upper and lower shell including a locked configuration and an unlocked configuration, wherein the locked configuration restricts movement between the upper and lower shell in a plurality of orientations, and wherein the unlocked configuration enables articulation freedom between the upper and lower shell in at least two orientations corresponding to anatomical supination, pronation, dorsiflexion, and plantarflexion between the upper and lower shell, and wherein the articulation system is configured to enable a selective engagement of the locked configuration and the unlocked configuration directly by hand;

wherein the articulation system includes an upper shell coupler and a lower shell coupler coupled to the upper and lower shell respectively, and wherein the locked configuration corresponds to an engagement between the upper shell coupler and the lower shell coupler, and wherein the unlocked configuration corresponds to a disengagement between the upper shell coupler and the lower shell coupler, and wherein the upper shell coupler is coupled within a recess of the upper shell so as to substantially restrict freedom between the upper shell coupler and the upper shell to coronal rotation corresponding to anatomical supination and pronation; and wherein the articulation system includes a selectable locking mechanism configured to selectably engage and release the coupling between the lower shell coupler and the upper shell coupler corresponding to the locked configuration and the unlocked configuration respectively, and wherein the selectable locking mechanism includes a retractable pin configured to selectably extend substantially orthogonal to the lower shell through a recess in the lower shell coupler, and wherein the retractable pin is moveable with a toggle switch such that a first position of the toggle switch corresponds to the pin being extended through the recess in the lower shell coupler and a second position of the toggle switch corresponds to the pin being retracted from the recess in the lower shell coupler.

* * * * *